US009204765B2

(12) United States Patent
McNulty et al.

(10) Patent No.: US 9,204,765 B2
(45) Date of Patent: Dec. 8, 2015

(54) OFF-AXIS INVERTED FOAM DISPENSERS AND REFILL UNITS

(71) Applicant: GOJO Industries, Inc., Akron, OH (US)

(72) Inventors: John J. McNulty, Broadview Heights, OH (US); Cory J. Tederous, Stow, OH (US); Robert L. Quinlan, Stow, OH (US); Nick E. Ciavarella, Seven Hills, OH (US); Donald R. Harris, Tallmadge, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/787,474

(22) Filed: Mar. 6, 2013

(65) Prior Publication Data

US 2014/0054322 A1 Feb. 27, 2014

Related U.S. Application Data

(63) Continuation-in-part of application No. 13/747,909, filed on Jan. 23, 2013, now Pat. No. 9,038,862, and a continuation-in-part of application No. 13/770,360, filed on Feb. 19, 2013.

(60) Provisional application No. 61/692,290, filed on Aug. 23, 2012, provisional application No. 61/695,140, filed on Aug. 30, 2012, provisional application No. 61/736,594, filed on Dec. 13, 2012, provisional application No. 61/720,490, filed on Oct. 31, 2012, provisional application No. 61/719,618, filed on Oct. 29, 2012.

(51) Int. Cl.

| | |
|---|---|
| ***B67D 7/76*** | (2010.01) |
| ***A47K 5/14*** | (2006.01) |

(Continued)

(52) U.S. Cl.

CPC ..... *A47K 5/14* (2013.01); *B05B 7/0025* (2013.01); *B05B 11/3015* (2013.01); *B05B 11/3087* (2013.01)

(58) Field of Classification Search

CPC ..... A47K 5/14; A47K 5/12; A47K 5/1202; A47K 5/1217; B05B 7/0025; B05B 11/3015; B05B 11/3087

USPC ..... 222/52, 108, 190, 181.1, 181.3, 184, 222/185.1, 325

See application file for complete search history.

(56) References Cited

U.S. PATENT DOCUMENTS 2,605,021 A * 7/1952 Churchill et al. ..... 222/153.03
2,904,222 A 9/1959 Philippe (Continued)

FOREIGN PATENT DOCUMENTS

CH 676227 A5 12/1990
EP 1147818 A1 10/2001

(Continued)

OTHER PUBLICATIONS

European Patent Office Search Report issued Jan. 7, 2011 in EP Application No. 09 150 880.2; 4 pages.

(Continued)

*Primary Examiner* — Patrick M Buechner
(74) *Attorney, Agent, or Firm* — Calfee, Halter & Griswold LLP

(57) ABSTRACT

An exemplary embodiment of a dispensing system includes a dispenser housing and a replaceable refill unit. The replaceable refill unit has a container that has a neck portion and a horizontal foam pump. The pump has an inlet orientated along an inlet axis and an outlet orientated along an outlet axis. A fluid passage extends from the pump chamber to the outlet. The inlet axis is offset from the outlet axis and the outlet axis is located closer to the front of the dispenser. An actuator is also located within the housing. In addition, an air compressor and an air passage to direct air into the fluid passage to mix the air with the fluid are included. The actuator is configured to drive the horizontal pump toward the front of the dispenser to dispense a fluid in the form of a foam.

16 Claims, 4 Drawing Sheets

(51) Int. Cl.
*B05B 7/00* (2006.01)
*B05B 11/00* (2006.01)

(56) References Cited

U.S. PATENT DOCUMENTS

| | | | | | |
|---|---|---|---|---|---|
| 3,250,438 | A | * | 5/1966 | Packwood, Jr. | 222/181.2 |
| 3,851,801 | A | | 12/1974 | Roth | |
| 4,018,363 | A | * | 4/1977 | Cassia | 222/80 |
| 4,036,406 | A | * | 7/1977 | Jespersen et al. | 222/181.2 |
| 4,168,020 | A | | 9/1979 | Benson | |
| 4,330,071 | A | | 5/1982 | Ohlson | |
| 4,345,627 | A | * | 8/1982 | Cassia | 141/18 |
| 4,391,308 | A | * | 7/1983 | Steiner | 141/18 |
| 4,391,309 | A | * | 7/1983 | Steiner | 141/18 |
| 4,437,585 | A | * | 3/1984 | Banks | 222/181.2 |
| 4,493,440 | A | * | 1/1985 | von Buelow et al. | 222/109 |
| 4,793,522 | A | | 12/1988 | Corsette | |
| 4,880,161 | A | | 11/1989 | Wright | |
| 4,946,070 | A | * | 8/1990 | Albert et al. | 222/52 |
| 4,946,072 | A | * | 8/1990 | Albert et al. | 222/105 |
| 4,972,978 | A | * | 11/1990 | DeLuca | 222/341 |
| 4,986,453 | A | | 1/1991 | Lina et al. | |
| 5,100,030 | A | | 3/1992 | Roggenurg et al. | |
| 5,174,476 | A | * | 12/1992 | Steiner et al. | 222/181.2 |
| 5,209,377 | A | | 5/1993 | Steiner et al. | |
| 5,271,530 | A | | 12/1993 | Uehira et al. | |
| 5,379,917 | A | * | 1/1995 | Brown et al. | 222/4 |
| 5,439,140 | A | | 8/1995 | Meyer | |
| 5,439,144 | A | | 8/1995 | Holzner | |
| 5,445,288 | A | | 8/1995 | Banks | |
| 5,452,825 | A | * | 9/1995 | Comstock et al. | 222/135 |
| 5,462,208 | A | | 10/1995 | Stahley et al. | |
| 5,605,256 | A | * | 2/1997 | Fan | 222/181.2 |
| 5,791,525 | A | * | 8/1998 | Fan | 222/181.3 |
| 5,799,841 | A | | 9/1998 | Wirt | |
| 5,823,397 | A | * | 10/1998 | Gil | 222/181.3 |
| 5,826,755 | A | | 10/1998 | Burd | |
| 5,836,482 | A | * | 11/1998 | Ophardt et al. | 222/325 |
| 5,862,954 | A | | 1/1999 | Ehrensperger | |
| 5,899,363 | A | | 5/1999 | Bliss, III et al. | |
| 5,906,299 | A | | 5/1999 | Hagleitner | |
| 5,960,991 | A | * | 10/1999 | Ophardt | 222/1 |
| 6,016,936 | A | * | 1/2000 | Fan | 222/181.1 |
| 6,065,647 | A | | 5/2000 | Bliss, III et al. | |
| 6,206,238 | B1 | * | 3/2001 | Ophardt | 222/1 |
| 6,209,751 | B1 | * | 4/2001 | Goodin et al. | 222/52 |
| 6,446,840 | B2 | | 9/2002 | Ophardt et al. | |
| 6,971,549 | B2 | | 12/2005 | Leifheit et al. | |
| 7,059,282 | B2 | | 6/2006 | Vorih et al. | |
| 7,377,758 | B2 | | 5/2008 | Sallows et al. | |
| 7,815,076 | B2 | | 10/2010 | Ophardt | |
| 7,926,413 | B2 | * | 4/2011 | Hart | 99/279 |
| 8,579,159 | B2 | | 11/2013 | Ciavrella | |
| 2003/0000967 | A1 | * | 1/2003 | Ehrensperger et al. | 222/190 |
| 2004/0031816 | A1 | | 2/2004 | Schuman | |
| 2004/0206772 | A1 | | 10/2004 | Leifheit | |
| 2004/0226962 | A1 | * | 11/2004 | Mazursky et al. | 222/95 |
| 2006/0273114 | A1 | | 12/2006 | Ophardt | |
| 2007/0251953 | A1 | * | 11/2007 | Criswell et al. | 222/105 |
| 2007/0272709 | A9 | | 11/2007 | Ciavarella et al. | |
| 2008/0272148 | A1 | | 11/2008 | Malik et al. | |
| 2009/0008408 | A1 | * | 1/2009 | Ophardt et al. | 222/1 |
| 2009/0101671 | A1 | * | 4/2009 | Cittadino et al. | 222/23 |
| 2009/0140004 | A1 | * | 6/2009 | Scorgie | 222/52 |
| 2010/0012679 | A1 | * | 1/2010 | Brownlee | 222/52 |
| 2010/0096412 | A1 | | 4/2010 | Law | |
| 2010/0147894 | A1 | | 6/2010 | Reimann et al. | |
| 2011/0017769 | A1 | * | 1/2011 | Ophardt | 222/1 |
| 2011/0079614 | A1 | | 4/2011 | Ganzeboom et al. | |
| 2011/0168739 | A1 | * | 7/2011 | Brouwer | 222/190 |
| 2012/0217267 | A1 | * | 8/2012 | Bunoz et al. | 222/145.5 |
| 2013/0056496 | A1 | * | 3/2013 | Coleman | 222/185.1 |
| 2013/0306678 | A1 | * | 11/2013 | Criswell et al. | 222/181.3 |
| 2013/0315031 | A1 | * | 11/2013 | Bunoz et al. | 366/182.2 |
| 2013/0341355 | A1 | * | 12/2013 | Weaver et al. | 222/108 |
| 2014/0124531 | A1 | | 5/2014 | Muderlak et al. | |
| 2014/0217117 | A1 | | 8/2014 | Mirbach | |

FOREIGN PATENT DOCUMENTS

| | | | |
|---|---|---|---|
| EP | 2080464 | A2 | 7/2009 |
| EP | 2080560 | A1 | 7/2009 |
| GB | 1269545 | | 4/1972 |
| GB | 2301812 | | 12/1996 |
| GB | 2472235 | | 2/2011 |
| WO | 2011157975 | A1 | 12/2011 |

OTHER PUBLICATIONS

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

International Search Report and Written Opinion from International Application No. PCT/US2014/035072, date of mailing Jul. 23, 2014.

International Search Report and Written Opinion from International Application No. PCT/US2014/012440, date of mailing Jun. 23, 2014.

* cited by examiner

OFF-AXIS INVERTED FOAM DISPENSERS AND REFILL UNITS

CROSS REFERENCE TO RELATED APPLICATIONS

This non-provisional utility patent application claims priority to and the benefits of U.S. Provisional Patent Application Ser. No. 61/692,290 filed on Aug. 23, 2012 and entitled Horizontal Pumps, Refill Units and Foam Dispensers with Integral Air Compressors; U.S. Provisional Patent Application Ser. No. 61/695,140 filed on Aug. 30, 2012 and entitled Horizontal Pumps, Refill Units and Foam Dispensers; U.S. Provisional Patent Application Ser. No. 61/736,594 filed on Dec. 13, 2012 and entitled Collapsible Container; U.S. Provisional Patent Application Ser. No. 61/720,490 filed on Oct. 31, 2012 and entitled Foam Pumps with Lost Motion and Adjustable Output Foam Pumps; U.S. Provisional Patent Application Ser. No. 61/719,618 filed on Oct. 29, 2012 and entitled Horizontal Pumps, Refill Units and Foam Dispensers; U.S. Non-Provisional patent application Ser. No. 13/747,909 filed on Jan. 23, 2013 and entitled Pumps with Container Vents; and U.S. Non-Provisional patent application Ser. No. 13/770,360, filed on Feb. 19, 2013 and entitled Power Systems For Touch Free Dispensers and Refill Units Containing a Power Source. All of these applications incorporated herein by reference in their entirety.

TECHNICAL FIELD

The present invention relates generally to dispensers and refill units for dispensers and more particular to off-axis foam dispensers and refill units for off-axis foam dispensers.

BACKGROUND OF THE INVENTION

Inverted foam dispensers are generally configured to provide a user with an amount of soap or sanitizer in the form of foam upon actuation of the dispenser. Inverted foam dispensers generally convert liquid material, such as liquid soap or sanitizer, into foam by aerating the liquid material as it is dispensed. Air is generally injected into the liquid material to form air bubbles in the liquid, causing the formation of foam. Inverted foam dispensers may include a replaceable refill container that is replaced after the liquid material therein is consumed by the user. Prior art inverted foam dispensers typically have a liquid inlet and a foam outlet that lie along a common axis. Accordingly, to move the foam outlet to a position that is suitable to dispense the foam on an object, the prior art offsets the neck of the container from the center of the container, which results in difficulties in manufacturing the containers, and/or containers that may not be aesthetically pleasing.

SUMMARY

Exemplary embodiments of inverted dispenser systems and refill units are disclosed herein. An exemplary embodiment of a self-contained inverted dispensing system includes a dispenser housing. A replaceable refill unit is inserted at least partially in the housing. The replaceable refill unit has a container. The container has a neck portion. A horizontal foam pump is secured to the neck portion. The pump has an inlet orientated along an inlet axis. The pump has a liquid pump chamber and a stationary outlet orientated along an outlet axis. A fluid passage extends from the pump chamber to the outlet. The inlet axis is offset from the outlet axis and the outlet axis is located closer to the front of the dispenser than the inlet axis. An actuator is also located within the housing. In addition, an air compressor is also included in the system. The air compressor has an air passage to direct air into the fluid passage to mix the air with the fluid. The actuator is configured to drive the horizontal pump toward the front of the dispenser to dispense a fluid and the pump moves toward the back of the dispenser to recharge the pump chamber within the pump.

Another exemplary embodiment of a touch-free inverted dispensing system includes a housing and a refill unit having a stationary outlet for dispensing a fluid. The refill unit is configured to fit at least partially within the housing. The housing has a back side and a front side. The front side is located a first distance from the back side of the housing. The stationary outlet of the refill unit is located a second distance from the back side of the housing. In some embodiments, the second distance is between about 65% to 90% of the first distance. In some embodiments, the second distance is between about 70% to 80% of the first distance, and in some embodiments, the second distance is about 75% of the first distance.

An exemplary embodiment of a refill unit for an inverted dispenser includes a container that includes a neck. A horizontal foam pump is secured to the neck. The horizontal foam pump has a liquid inlet located proximate the neck of the container. A liquid pump chamber located downstream of the inlet. An outlet is located downstream of the liquid pump chamber. The outlet is offset from the inlet along at least two axis. An air compressor having an air chamber is also included. An air passage places the air compressor in fluid communication with a fluid passage of the pump. At least a portion of the air passage is located at a bottom of the air chamber. A one-way air inlet valve located at least partially within the air chamber to allow air to flow into the air chamber. The one-way air inlet valve has a cracking pressure that is high enough to cause at least a portion of the air flowing into the air chamber to be drawn in from the outlet when the air chamber is recharged.

BRIEF DESCRIPTION OF THE DRAWINGS

These and other features and advantages of the present invention will become better understood with regard to the following description and accompanying drawings in which.

DETAILED DESCRIPTION

Figure 1C:
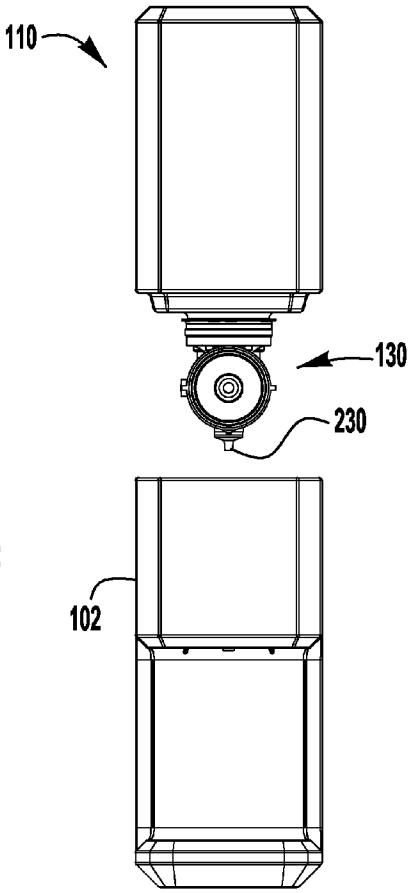
FIG. 1C is a front view of the exemplary dispenser housing 102 and the exemplary refill unit 110 with the refill unit 110 removed from the dispenser housing 102 removed.
Figure 1B:
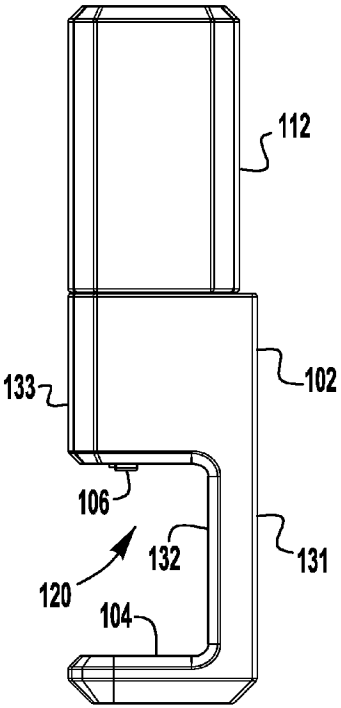
FIG. 1B is a side view of the exemplary dispenser system 100.
Figure 1A:
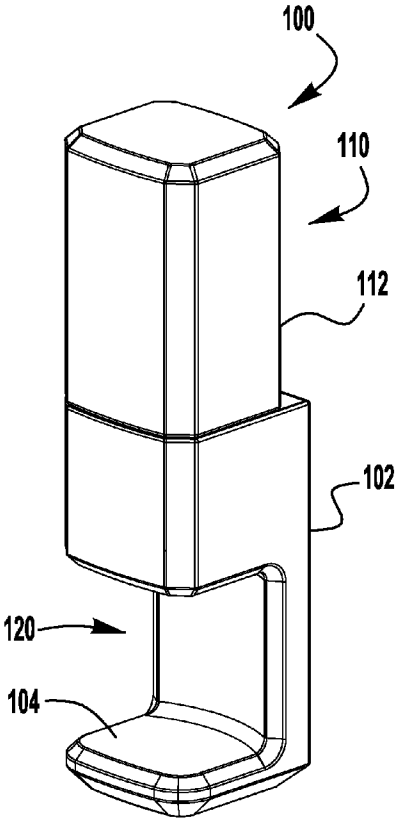
FIG. 1A is a prospective view of an exemplary dispenser system 100.

FIGS. 1A and 1B illustrate an exemplary embodiment of a dispenser system 100 that includes a housing 102 and refill unit 110. Refill unit 110 includes a non-collapsing container 112 and pump 130. Dispenser housing 102 is open at the top. When a refill unit 110 needs to be replaced, refill unit 110 is simply lifted upward and removed and a new refill unit 110 is inserted into the top of the dispenser housing 102. Dispenser housing 102 includes a drip catcher 104. Dispenser system 100 also includes an sensor 106 for sensing the presence of an object in a dispense zone 120. FIG. 1C illustrates the dispenser housing 102 and the refill unit 110 illustrates with_the refill unit 110 removed from the dispenser housing 102.

Figure 2:
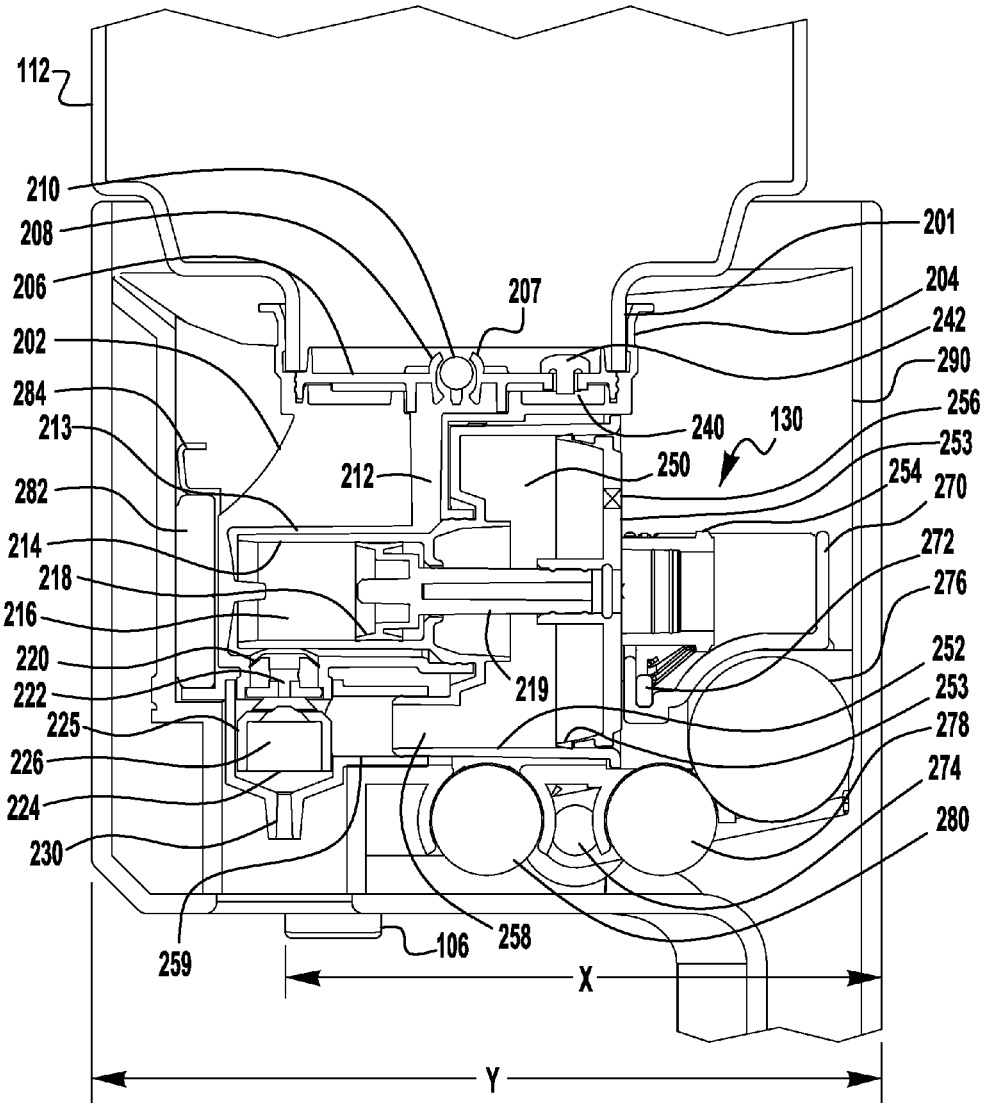
FIG. 2 illustrates a partial cross-sectional view of the exemplary dispenser system 100 and FIG. 2A illustrates an exemplary insert for the dispenser system 100.

FIG. 2 illustrates a partial cross-sectional view of the exemplary dispenser system 100. As described above, dispenser system 100 includes refill unit 110 and dispenser housing 102. Refill unit 110 also includes container 112 and foam pump 130. In this exemplary embodiment, the container 112 includes a foamable liquid, such as, for example, a soap, a sanitizer, a lotion or the like.

Container 112 has a central axis and is symmetrical the neck 201 of container 112 has a center that lies along the central axis of the container. Exemplary container 112 is a blow molded container. It has been discovered that it is easier to blow mold a container, such as container 112, if the neck 201 of the container 112 is located in the center of the container 112. Having the neck 201 in the center of the container 112 results in a more even thickness of the container walls. In addition, the appearance of the container 112 is more aesthetically pleasing because the walls can be more transparent uniform and not deflect light in an irregular pattern due to uneven flow of blown bottle. Flow lines build up in containers with offset necks resulting in an unattractive appearance. Prior art containers for inverted foam dispensers often have the neck of the container offset because prior art pumps have their inlets and outlets along a common vertical axis and to dispense fluid in a preferred location in the dispensing zone 120, the neck of the prior art containers are offset from the center of the container.

In the exemplary embodiment of the of the dispensing system 100 the container 112 is exposed and accordingly, the appearance of the container 112 is very important. In addition, because the container 112 is disposed of when it is empty, manufacturing costs are of concern when manufacturing the container 112. Blow molding of the container 112 is an inexpensive method of manufacturing the container 112 and having the neck located in the center of the container 112 provides the most aesthetically pleasing container possible with such a manufacturing process.

As illustrated in FIG. 2, a pump housing 202 is secured to neck 201 of container 112 by collar 204. Collar 204 is secured to container 112 by a snap-fit connection; however, it could be connected by any means, such as, for example a threaded connection, a welded connection, an adhesive connection or the like. Located between pump housing 202 and container neck 201 is plate 206. Plate 206 includes an aperture 207 surrounded by valve seat 208 which provides a seat for inlet ball valve 210. Inlet ball valve 210 is a normally open valve. Accordingly, liquid may flow past the inlet ball valve 210 into liquid inlet channel 221, past sleeve 214 and into liquid pump chamber 216. When pump chamber 216 is pressurized, as discussed in detail below, inlet ball valve 210 seals against seat 208 to prevent liquid from flowing from pump chamber 216 back into container 112. In some embodiments, ball valve 210 may be a normally closed valve and in that case may include a biasing member (not shown) to bias the ball valve 210 closed. In addition, although the one-way liquid inlet valve is a ball valve, other types of one-way inlet valves may be used, such as, for example, a mushroom valve, an umbrella valve, a poppet valve, a flapper valve, or the like.

Pump housing 202 includes a cavity 213. Located within cavity 213 is a sleeve 214. A liquid piston 218 moves in a back and forth reciprocating motion within sleeve 214 to increase and decrease the volume of pump chamber 216. Similarly, located within cavity 213 is an air piston sleeve 253. Air piston 252 moves in a back and forth reciprocating motion within air piston sleeve 253 to increase and decrease the volume of air chamber 250.

The liquid piston 218 is connected to liquid piston stem 219. Liquid piston stem 219 is connected to air piston 252. Accordingly, movement of air piston 252 also moves liquid piston 218. Air piston 252 also includes connector 254. Connector 254 mates with lost motion connector 272 when the refill unit 110 is inserted into dispenser housing 202.

Figure 2A:
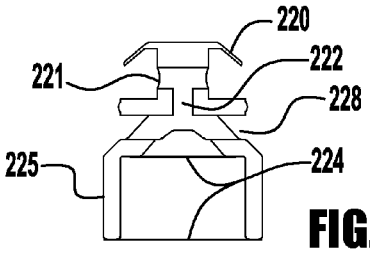

Foam pump 130 includes an insert 225. The components of insert 225 are shown in FIG. 2A for purposes of clarity. Insert 225 includes one-way liquid outlet valve 220 that contacts pump housing 202. The one-way liquid outlet valve 220 allows liquid under pressure to escape liquid pump chamber 216. Insert 225 includes liquid passages 221, 222 and air passages 228. Liquid passage 222 and air passage 228 intersect at an angle of about 90 degrees to one another. Located downstream of the liquid passage 222 and air passages 228 is a foaming chamber that contains one or more screens 224 which aid in mixing the liquid and air to form a foam. The screens 224 are separated by an open area 226. Other elements may be used for the foaming chamber, such as, for example, a sponge, baffles or other types of porous materials.

Connected to housing 202 and located below insert 225 is outlet nozzle 230. Outlet nozzle 230 retains insert 225 within housing 202. In this exemplary embodiment, outlet nozzle 230 is funnel shaped and, as foam flows through outlet nozzle 230 the velocity of the foam is increased helping to enrich the foam.

Located between air compressor chamber 250 is an air outlet passage 258. Air outlet passage 258 is elongated and located at the bottom of air chamber 250. In some embodiments, air outlet passage 258 includes a stepped down portion 259 where the air outlet passage 258 connects to pump housing 259. This stepped down portion may trap and retain residual foam and liquid that is sucked back into air chamber 250 as air piston 252 is moved back to its charged position.

In some embodiments, the dispenser housings 102, 302 (FIG. 3A-3C) are configured so that when refill units 110, 310 (FIG. 4) are installed in their respective dispensers, the refill units 110, 310 are tilted or angled forward slightly. Thus, any residual fluid remains at the end of air passage 258 away from air piston seal 252. Ensuring that the residual fluid remains at the far end of air passage 258 eliminates the possibility of leakage around air piston 252 if the pump remains stationary for a length period of time.

In some embodiments, a one-way air inlet valve 256 is located in the body of air piston 253. In some embodiments, a one-way air inlet valve (not shown) is located in a wall of air piston sleeve 253. One-way air inlet valve 256 has a cracking pressure that is selected so that when air piston 252 is moved from a fully discharged position toward the fully primed or charged position (as illustrated in FIG. 2) air is drawn in through though the outlet nozzle 230 and sucks back residual foam and liquid up through air passages 228. As the air piston 252 moves toward its fully charged position, the vacuum pressure in air chamber 250 increases because of the resistance caused by the foaming screens and air passage 224. Once the vacuum pressure increases to a set point, the one-way air inlet valve 256 opens and allows air to flow into air chamber 250. In some embodiments, a cracking pressure of about 3 psi is selected. Thus, foam pump 130 provides for a limited suck back of foam and extends battery life because the one-way air inlet valve 256 allows air piston 252 to move back without the increased resistance of the screen(s) 224.

Container 112 is a non-collapsible container and therefore needs to be vented to prevent vacuum pressure from preventing the pump 130 from operating properly. In this exemplary embodiment, a one-way air inlet valve 242 is provided to vent the container 112. Once vacuum pressure in container 112 exceeds the cracking pressure of one-way air inlet valve 242, one-way air inlet valve 242 opens and allows air to flow from air chamber 240 into container 112. Air is able to enter air chamber 240 through channels (not shown) in collar 242. Additional detailed descriptions of structures for venting methods and for additional venting methods are provided in U.S. Non-Provisional patent application Ser. No. 13/747,909 filed on Jan. 23, 2012 and entitled Pumps with Container Vents, which is incorporated in its entirety herein by reference.

In this exemplary embodiment, dispenser housing 102 includes a lost motion connector 272. Lost motion connector 272 is connected to actuator 270 and both are secured to dispenser housing 202 and remain with dispenser housing 202 when the refill unit 210 is removed. Actuator 270 moves in a linear back and forth motion and is driven by motor 276 and associated gearing.

Lost motion connector 272 may be adjustable in the field or at the factory. In addition, lost motion connector 2782 may have settings that range from no lost motion all the way up to a maximum lost motion. At "no lost motion" the pump dispenses a full or maximum dose. If the lost motion connector 272 is set at its maximum lost motion setting, the pump its dispenses the smallest dose allowable. Additional applicable lost motion connectors are more fully described in co-pending U.S. Provisional Patent Application Ser. No. 61/720,490 filed on Oct. 31, 2012 and entitled Foam Pumps with Lost Motion and Adjustable Output Foam Pumps, which is incorporated herein in its entirety by reference. In some embodiments, the lost motion connector 272 is not needed and actuator 270 directly connects to connector 254.

During operation, a controller (not shown) detects an object is present in dispensing zone 120 through sensor 106 and causes motor 276 to operate actuator 270 and dispense a dose of foam. Dispenser housing 202 includes batteries 278, 280. In some embodiments, batteries 278, 280 have sufficient power to actuate the actuator 270. In such embodiments, the batteries may be replaceable.

In some embodiments dispenser housing 202 includes a rechargeable device (not shown), such as, for example, a bank of capacitors (not shown), or one or more rechargeable batteries (not shown) and the refill unit 110 includes a disposable battery 282 secured to refill unit 110 by retainer 284. Dispenser housing 202 includes a connector (not shown) for connecting to the disposable battery. The connector may be, for example, a set of conductors that contact a mating set of conductors on the disposable battery 282 as is known in the art.

Housing 102 includes circuitry that allows disposable battery 282 to be used to charge the rechargeable device to power the actuator 270. Exemplary embodiments of refill units with disposable batteries and circuitry for such exemplary embodiments are shown and described in co-pending U.S. Non-Provisional patent application Ser. No. 13/770,360, filed on Feb. 19, 2013 and entitled Power Systems For Touch Free Dispensers and Refill Units Containing a Power Source, which is incorporated in its entirety herein by reference. In such a case, one or both of batteries 278, 280 may be permanent batteries that remain with the dispenser throughout the life of the dispenser housing 202. The exemplary dispenser system 100 includes a bank of capacitors that are charged in parallel and placed in series to operate actuator 270, which is fully described in the above referenced co-pending application.

Other offset foam pumps having both an air chamber and a liquid chamber that may be used in the exemplary dispensing system 100 (and 300 described in detail below) include the foam pumps shown and described in Provisional Patent Application Ser. No. 61/695,140 filed on Aug. 30, 2012 and entitled Horizontal Pumps, Refill Units and Foam Dispensers and in U.S. Provisional Patent Application Ser. No. 61/719,618 filed on Oct. 29, 2012 and entitled Horizontal Pumps, Refill Units and Foam Dispensers. Both of these applications are incorporated in their entirety herein by reference.

In addition, in some embodiments, an air compressor is permanently affixed to dispenser housing 102. In such an embodiment, liquid pumps having an inlet for receiving air from the air compressor affixed to the dispenser housing 102 are used in the dispenser systems disclosed herein. Exemplary pumps, refill units and air compressors that may be used are shown and described in U.S. Provisional Patent Application Ser. No. 61/692,290 filed on Aug. 23, 2012 and entitled Horizontal Pumps, Refill Units and Foam Dispensers with Integral Air Compressors, which is also incorporated in its entirety herein by reference.

The design of the offset axis pumps allow the container 112 to have the neck 201 located on a center of the container 112 and allows the outlet 230 to be located at a distance X away from the back surface 131 of dispenser housing 102 to the center of the outlet nozzle 230. Thus, a user may place her hands in a location suitable for foam to be properly dispensed on them from outlet 230. In one embodiment, the distance from the back surface 131 to the center of the outlet nozzle is about 3 inches and the distance from the back surface to the front surface 133 is about 4 inches. In some embodiments, the distance X from the back surface 131 to the center of the outlet nozzle 230 is between about 60% and 90% of the distance Y from the back surface 131 to the front surface 133. In some embodiments the distance X is between about 70% and 80% of the distance Y. In some embodiments, the distance X is about 75% of the distance Y.

In operation, inverted foam dispenser housing 102 is mounted to a wall (not shown), placed on a stand (not shown) or set on a counter (not shown). A user may adjust the lost motion mechanism 272 to dispense full dose or to dispense a smaller dose depending on the location of the device and the user's requirements. A refill unit 110 is lowered into housing 102 so that connector 254 is received by lost motion connector 272 and the dispenser system 100 is ready to operate.

Upon detection of an object in the dispensing zone 120 by sensor 106, a controller (not shown) causes motor 252 and associated gearing move the air piston 252 and liquid piston 218 towards the front of dispenser housing 102 thereby compressing the liquid pump chamber 216 and the air pump chamber 250. Liquid flows out of liquid pump chamber 216 around sleeve 214, past one-way liquid outlet valve 220 of insert 225, through liquid passages 221, 222 where it mixes with air flowing from air compressor chamber 250, air passages 258, 228. The air/liquid mixture passes through first screen 224 where the mixture is aerated and forms a foam as it enters area 226. The foam mixture is then forced through a second screen 224 and flows through outlet 230. Outlet 230 narrows and, accordingly, the velocity of the foam is increased as it is dispensed.

Upon completion of the dispense cycle, actuator 270 is moved backward by motor 276 and associated gearing. The lost motion connector 272 engages connector 254 to move air piston 252 and liquid piston 218 back to their fully primed position. Lost motion connector 272 may immediately engage connector 254 (if it is set at "no lost motion") or it may move a predetermined distance, based on the dispense dose setting of lost motion connector 254, before engaging connector 254 to move pistons 252 and 218 rearward.

As air piston 252 moves rearward, air, foam, and residual liquid in passage 228, area 226 and outlet 230 are drawn into air passage 258 to prevent dripping of liquid out of the outlet nozzle 230 after the dispense cycle. In some embodiments, the residual fluid is retained in area 259 of the air passage 258. Once sufficient vacuum pressure develops in air pump chamber 250 due to the resistance to the air flow through the outlet nozzle 230, screens 224 and passage 228, one-way air inlet valve 256 opens allowing air to flow into air pump chamber 250. Once actuator 270 reaches its rearmost position, the foam pump 130 is primed and ready for its next dispense cycle.

Figure 3D:
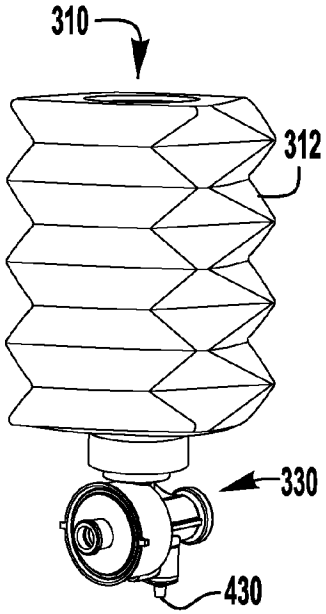
FIG. 3D is a rear view of an exemplary refill unit 310 for dispenser system 300.
Figure 3C:
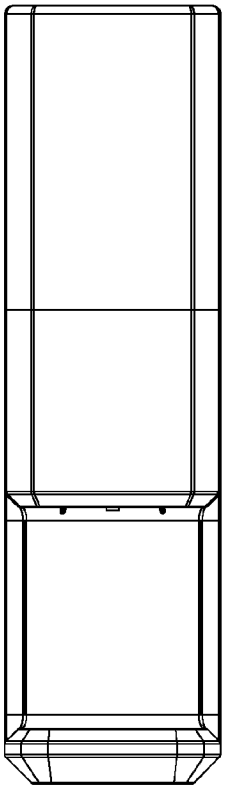
FIG. 3C is a front view of the exemplary dispenser system 300.
Figure 3B:
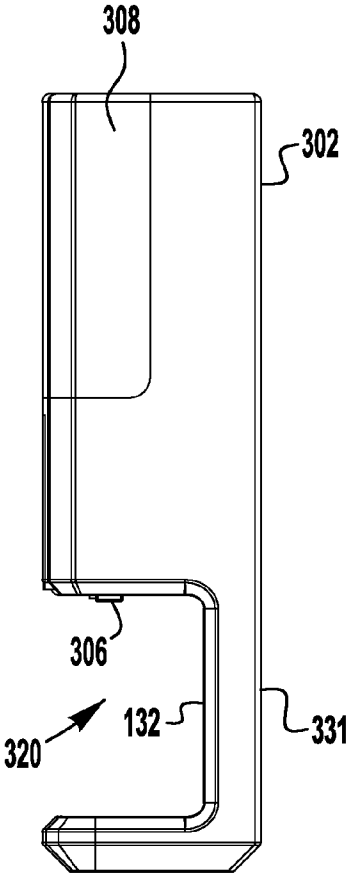
FIG. 3B is a side view of the exemplary dispenser system 300.
Figure 3A:
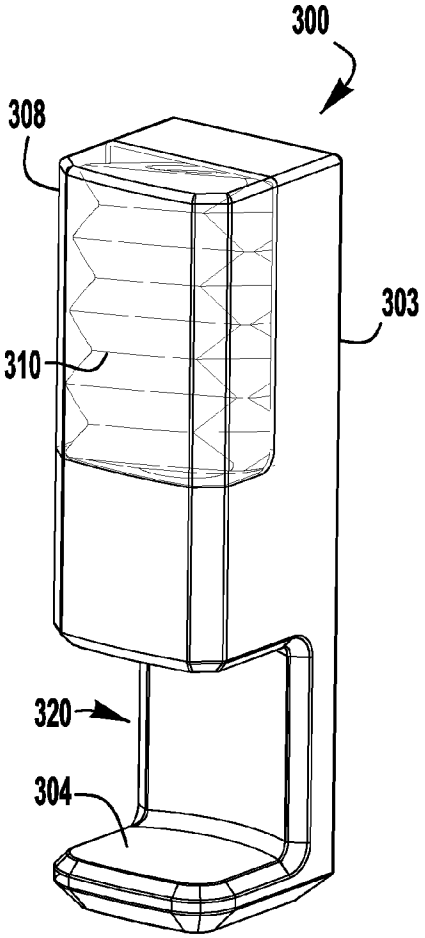
FIG. 3A is a prospective view of an exemplary dispenser system 300.

FIGS. 3A, 3B and 3C illustrate an exemplary embodiment of a dispenser system 300 that includes a housing 302 and refill unit 310. Refill unit 310 includes a collapsible container 312 and pump 330. Dispenser housing 302 includes a window 308 through which refill unit 310 is visible. In one embodiment, window 308 pivots outward to expose the interior of housing 302 so that the refill unit 310 may be inserted into the dispenser housing 302 through window 308. Dispenser housing 302 includes a drip catcher 304. Dispenser system 300 also includes an sensor 306 for sensing the presence of an object in a dispense zone 320. FIG. 3D illustrates an exemplary refill unit 310 removed from the dispenser housing 302. Exemplary embodiments of collapsible containers and refill units are shown and described in U.S. Provisional Patent Application Ser. No. 61/736,594 filed on Dec. 13, 2012 and entitled Collapsible Container, which is incorporated herein in its entirety by reference.

Figure 4:
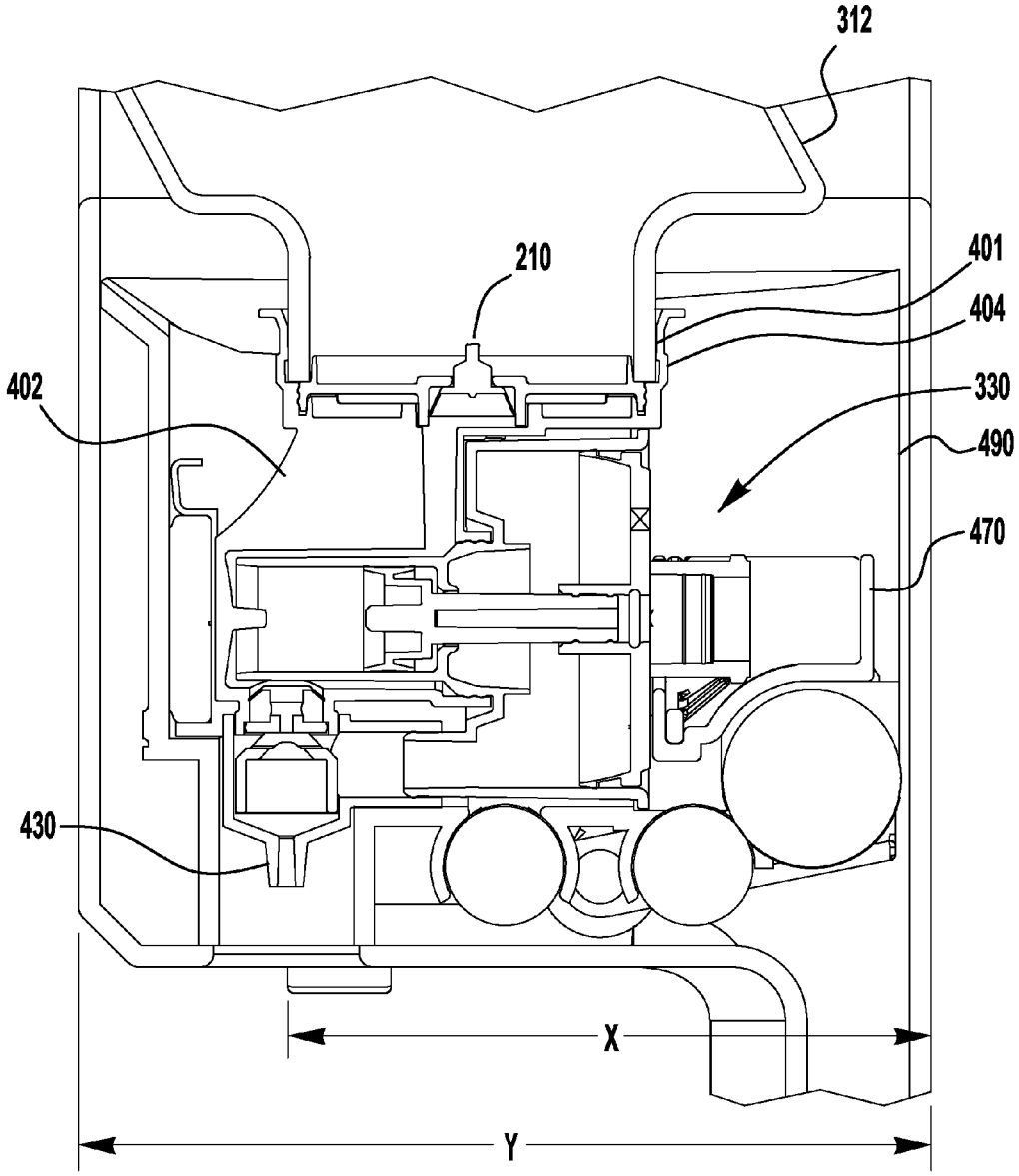
FIG. 4 illustrates a partial cross-sectional view of the exemplary dispenser system 300.

FIG. 4 is a partial cross-section of the exemplary dispenser system 300. Many of the internal components of dispenser system 300 are similar to the internal components of dispenser system 100. Accordingly, many of these components have not been renumbered and re-described herein with respect to dispenser system 300. On significant difference is that container 312 is a collapsible container, and therefore does not need a container vent.

In addition, inlet valve 210 is illustrated as a wiper valve that is normally closed. As discussed above inlet valve 210 may be a normally open or a normally closed inlet valve. Foam pump 330 is connected to the neck 401 of container 312 by collar 404. In this embodiment, collar 404 does not include channels for allowing air to enter an air chamber. The remaining components of pump 330 are substantially the same as the components of pump 130. Similarly, the internal components of housing 302 are substantially the same as those described above with respect to housing 202. In addition, the incorporated references are equally applicable to this exemplary embodiment unless noted otherwise.

In this exemplary embodiment of the of the dispensing system 300 the container 312 is exposed through the window. Accordingly, the appearance of the container 312 is important. Moreover, because container 312 is specifically designed for a controlled collapse and designed to collapse with a lower vacuum pressure than prior art collapsible containers, it is very desirable to have all of the walls a uniform thickness as opposed to having some walls thicker than others. In addition, because the container 312 is disposed of when it is empty, manufacturing costs are of concern when manufacturing the container 312. Blow molding of the container 312 is an inexpensive method of manufacturing the container 312 and having the neck located in the center of the container 312 provides the most aesthetically pleasing and uniform container possible with such a manufacturing process.

As described above, other offset foam pumps having both an air chamber and a liquid chamber that may be used in the exemplary dispensing system 300 include the foam pumps shown and described in co-pending Provisional Patent Application Ser. No. 61/695,140 filed on Aug. 30, 2012 and entitled Horizontal Pumps, Refill Units and Foam Dispensers and co-pending U.S. Provisional Patent Application Ser. No. 61/719,618 filed on Oct. 29, 2012 and entitled Horizontal Pumps, Refill Units and Foam Dispensers, which are both incorporated in their entirety herein by reference.

In addition, an air compressor may be permanently affixed to dispenser housing 302. In such an embodiment, liquid pumps having an inlet for receiving air from the air compressor affixed to the dispenser housing 302. Exemplary pumps that may be used are shown and described in U.S. Provisional Patent Application Ser. No. 61/692,290 filed on Aug. 23, 2012 and entitled Horizontal Pumps, Refill Units and Foam Dispensers with Integral Air Compressors, which is also incorporated in its entirety herein by reference.

Just as with the exemplary dispensing system 100, the design of the offset axis pumps allow the container 312 to have the neck 301 located on a center of the container 312 and allow the outlet 430 to be located at a distance X, which is far enough away from the back surface 331 of dispenser housing 102 to the center of the outlet nozzle 430 for a user to place her hands in a location suitable for foam dispensed from outlet 430 onto her hands.

In one embodiment, the distance from the back surface 331 to the center of the outlet nozzle is about 3 inches and the distance from the back surface to the front surface 133 is about 4 inches. In some embodiments, the distance X from the back surface 331 to the center of the outlet nozzle 430 is between about 60% and 90% of the distance Y from the back surface 331 to the front surface 333. In some embodiments the distance X is between about 70% and 80% of the distance Y. In some embodiments, the distance X is about 75% of the distance Y.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

We claim:

1. A foam dispensing system having inverted containers comprising:
- a dispenser housing;
- a replaceable refill unit inserted at least partially in the housing;
- the replaceable refill unit having
  - a container;
    - the container having a neck portion at the bottom of the container;
    - a horizontal foam pump secured to the neck portion;
      - the pump having an inlet orientated along an inlet axis;
      - the pump having a liquid pump chamber;
      - the pump having a stationary outlet orientated along an outlet axis;
      - the pump having a fluid passage extending from the pump chamber to the outlet;
      - wherein the inlet axis is offset from the outlet axis; and
      - the outlet axis is located closer to the front of the dispenser than the inlet axis;
- an actuator located within the housing; and
- an air compressor;
  - the air compressor having an air passage to direct air into the fluid passage;
  - wherein the air compressor has a cylindrical housing and the air passage is located at the bottom of the cylindrical housing.

2. The foam dispensing system of claim 1 wherein the container has a center axis and a center of the neck portion is positioned along the center axis.

3. The foam dispensing system of claim 2 wherein the outlet nozzle is located in the front 30% of the overall depth of the dispenser housing.

4. The foam dispensing system of claim 1 wherein the air compressor forms part of the replaceable refill unit.

5. A foam dispensing system having inverted containers comprising:
- a dispenser housing;
- a replaceable refill unit inserted at least partially in the housing;
- the replaceable refill unit having
  - a container;
    - the container having a neck portion at the bottom of the container;
    - a horizontal foam pump secured to the neck portion;
      - the pump having an inlet orientated along a vertical inlet axis;
      - the pump having a liquid pump chamber;
      - the pump having a stationary outlet orientated along a vertical outlet axis;
      - the pump having a fluid passage extending from the pump chamber to the outlet;
- an actuator located within the housing; and
- an air compressor;
- the air compressor having an air passage to direct air into the fluid passage; and
- a one-way air inlet valve having a cracking pressure selected so that when the air chamber expands, fluid is drawn in through the outlet nozzle providing suck back prior to the one-way air inlet valve opening to allow air to flow into the air compressor chamber through the one-way air inlet valve.

6. The foam dispensing system of claim 1 wherein the container is a non-collapsible container and the pump includes a container venting valve.

7. The foam dispensing system of claim 6 wherein a portion of the container is exposed and not contained within the housing.

8. The foam dispensing system of claim 1 further comprising a lost motion connector.

9. The foam dispensing system of claim 1 wherein the refill unit further comprises a battery secured to the refill unit and the battery is removable with the refill unit.

10. The foam dispensing system of claim 1 wherein the container is a collapsible container and the housing includes a transparent window for viewing the collapsible container.

11. The foam dispensing system of claim 1 wherein the dispenser is configured to hold the refill unit at an angle with the top of the refill unit tilted toward the front of the dispenser.

12. A foam dispensing system having inverted containers comprising:
- a dispenser housing;
- a replaceable refill unit inserted at least partially in the housing;
- the replaceable refill unit having
  - a container;
    - the container having a neck portion at the bottom of the container;
    - a horizontal foam pump secured to the neck portion;
      - the pump having an inlet orientated along a vertical inlet axis;
      - the pump having a liquid pump chamber;
      - the pump having a stationary outlet orientated along a vertical outlet axis;
      - the pump having a fluid passage extending from the pump chamber to the outlet;
      - wherein the vertical inlet axis is offset from the vertical outlet axis; and
      - the vertical outlet axis is located closer to the front of the dispenser than the vertical inlet axis;
- an actuator located within the housing; and
- an air compressor;
  - the air compressor having an air passage to direct air into the fluid passage;
  - wherein the air compressor has a cylindrical housing and the air passage is located at the bottom of the cylindrical housing.

13. The foam dispensing system of claim 12 wherein the container has a center axis and a center of the neck portion is positioned along the center axis and the vertical outlet axis is positioned off of the center axis.

14. The foam dispensing system of claim 12 wherein the outlet nozzle is located in the front 30% of the overall depth of the dispenser housing.

15. A foam dispensing system having inverted containers comprising:

a dispenser housing;

a replaceable refill unit inserted at least partially in the housing;

the replaceable refill unit having a container;

the container having a neck portion at the bottom of the container;

a horizontal foam pump secured to the neck portion;

the pump having an inlet orientated along a vertical inlet axis;

the pump having a liquid pump chamber;

the pump having a stationary outlet orientated along a vertical outlet axis;

the pump having a fluid passage extending from the pump chamber to the outlet;

an actuator located within the housing; and an air compressor;

the air compressor having an air passage to direct air into the fluid passage; and a one-way air inlet valve having a cracking pressure selected so that when the air chamber expands, fluid is drawn in through the outlet nozzle providing suck back prior to the one-way air inlet valve opening to allow air to flow into the air compressor chamber through the one-way air inlet valve.

16. The foam dispensing system of claim 15 wherein the refill unit further comprises a battery secured to the refill unit and the battery is removable with the refill unit.

* * * * *